United States Patent [19]

Branham

[11] Patent Number: 4,518,001

[45] Date of Patent: May 21, 1985

[54] COIN HANDLING APPARATUS

[75] Inventor: Doud R. Branham, Sparks, Nev.

[73] Assignee: International Game Technology, Reno, ; SR 3 03111985 32 05211985 ZZX None 10 1 1 Bartuska; F. J. 1 4

[21] Appl. No.: 371,548

[22] Filed: Apr. 26, 1982

[51] Int. Cl.[3] ..... G07D 1/00

[52] U.S. Cl. ..... 133/5 R; 194/DIG. 7; 221/267

[58] Field of Search ..... 133/4 R, 5 R, 2, 8 R, 133/8 A, 3 R, 3 C, 3 D, 3 H; 194/1 K, DIG. 7, DIG. 16, 1 E; 221/261, 267, 303, 307, 232

[56] References Cited

U.S. PATENT DOCUMENTS

| | | | |
|---|---|---|---|
| 2,598,010 | 5/1952 | Pillatsch | 194/1 E |
| 3,187,760 | 6/1965 | Simjian | 133/4 R |
| 3,788,334 | 1/1974 | Saraceno et al. | 133/4 R |
| 4,230,136 | 10/1980 | Heinricks | 133/8 R X |

*Primary Examiner*—F. J. Bartuska

*Attorney, Agent, or Firm*—Seiler, Quirk & Tratos

[57] ABSTRACT

In an improved coin handling apparatus including a hopper payout assembly, an improved device for delivering coins from the hopper to a coin tray comprises an elongated duct for receiving a stack of coins of a given denomination in single edge-to-edge relationship from the hopper and having a coin ejector assembly at the end of the duct opposite the hopper.

10 Claims, 4 Drawing Figures

COIN HANDLING APPARATUS

BACKGROUND OF THE INVENTION

In coin handling and payout apparatus such as slot machines or similar gaming devices there is need for an improvement for transferring coins from a payout hopper to a coin tray which is elevated from the hopper. Because of coin wear, or differences in the diameters of tokens of a single denomination from different sources, there is a significant problem in designing a passageway system between the hopper and coin tray having the necessary accuracy in handling, counting, and dispensing the coins because of variations in the height of the stack of the coins therein. The apparatus must also be relatively jam-proof which would otherwise seriously interfere with the efficiency of the apparatus causing substantial downtime in making the necessary repairs. It is to such an apparatus that the present invention is directed.

SUMMARY OF THE INVENTION

In the present invention there is provided an apparatus in which coins may be directed from a hopper which pays out a specific number of coins, to a coin payout tray, which is elevated from the hopper. The improved apparatus consists of an escalator or having an elongated duct in which a channel receives the coins in single edge-to-edge file or stack, and which includes means for ejecting the coins in such a manner to prevent jamming and to keep the outlet communicating between the chute and the coin tray clear. The specific components of the improved assembly as well as other advantages thereof will be evident from the following detailed description.

DETAILED DESCRIPTION OF THE INVENTION

Figure 1:
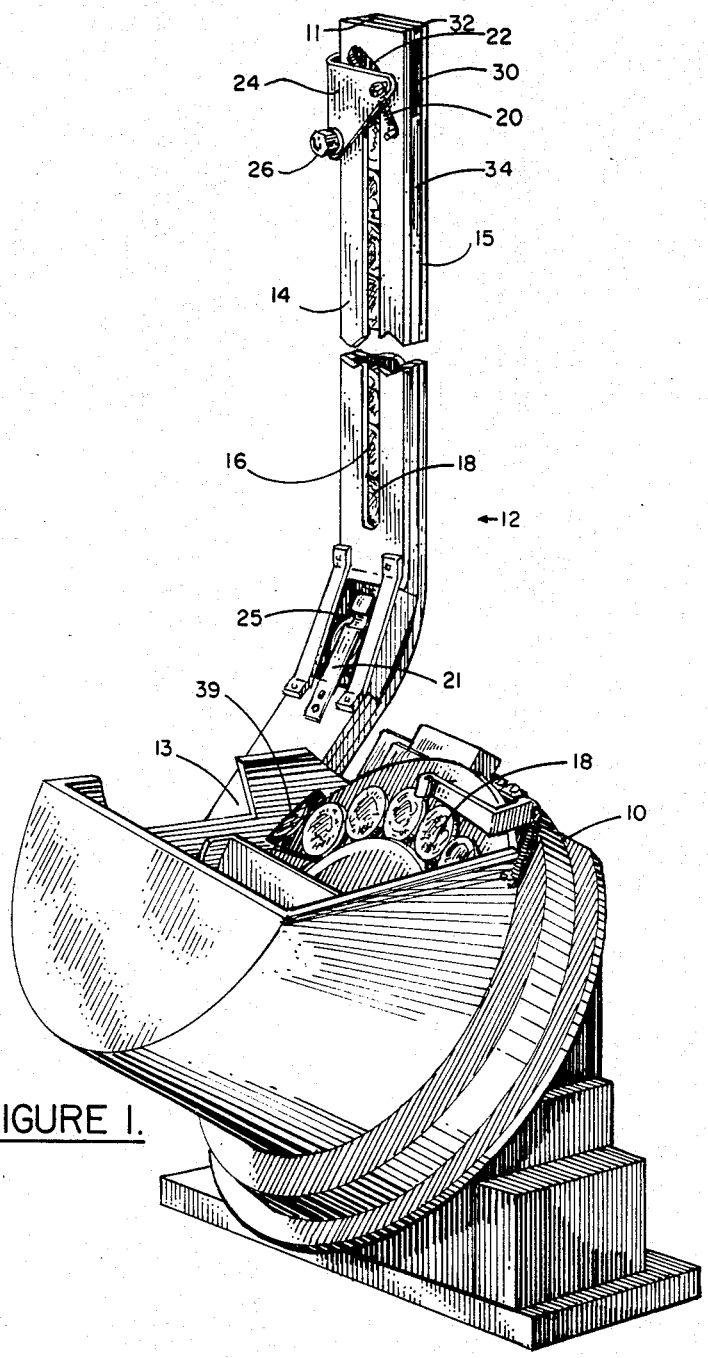
FIG. 1 is a elevational view of a hopper and the improved coin escalator assembly of the present invention.

As illustrated in FIG. 1, there is shown a hopper 10 to which is secured the coin handling escalator assembly 12 of the invention. The escalator is secured to the hopper adjacent its lower end 13 having an inlet 39 at the lower end through which coins 18 are received from the hopper. The escalator assembly comprises an elongated duct having a channel 25 in which the stack of coins of a single given denomination are received in an edge-to-edge file and an outlet adjacent the upper end 11 of the duct.

Figure 2:
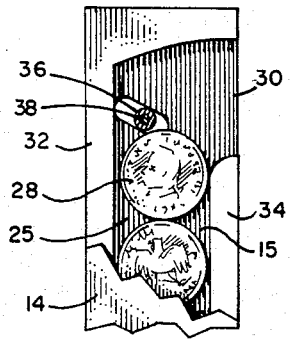
FIGS. 2–4 show the upper end of the escalator assembly, partially broken away, illustrating successive steps in the coin ejecting feature of the invention.
Figure 3:
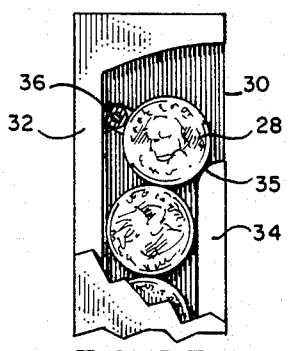
Figure 4:
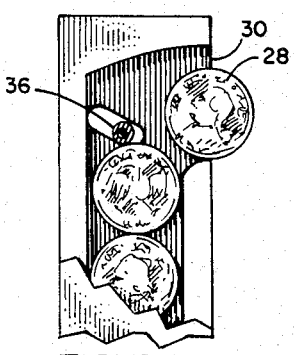

Observing also FIGS. 2–4, the duct is preferably made up of a front plate 14, a back plate 15 and a pair of edge panels or guides 32 and 34 secured together to define the channel 25. The channel has a depth between the front and back plates greater than the thickness of the coin denominations handled by the escalator, but less than twice the thickness of the coins, thereby preventing the possibility of a coin slipping behind or in front of an adjacent coin causing jamming in the channel. Of course, the width of the channel between the edge panels 32 and 34 is also greater than the diameter of the coins.

Front plate 14 also preferably is provided with an access opening 16 along a substantial portion of its length whereby jamming or other interruption of the movement of coins therealong can be readily obviated. This opening may also or alternately be present on the back plate 15. In another preferred embodiment, an enlarged access opening 17 is present between an upper and lower portions of the front plate into which a leaf spring 21, or other suitable retention means extends for urging the coins against the opposite plate. The enlarged opening 21 is of a size sufficient to allow coins to be extracted through the opening, for example, to empty the channel, when desired. Thus, the width of the opening must be sufficient to allow the coins to be removed, and spring 21, is of a length so as to prevent coins from passing through the opening when the spring is in place. The spring may be conveniently secured to the front plate by screws, or the like so that it may be temporarily removed to fully expose the opening.

An important feature of the coin handling escalator of the invention is a coin ejector for ejecting the uppermost coin from the channel. The coin ejector shown in the drawings comprises a roller 36 rotatably secured on a spindle or axle 38 which assembly is movable between a first position shown in FIG. 2 and a second position shown in FIG. 3. The roller and axle are mounted on a hinged bracket 24. A single hinge 26 in the form of a nut or the like is secured through a hole or opening in the bracket so that the bracket pivots on hinge 26. The bracket and axle 38 are biased by spring 20 to the first position shown in FIG. 2. In that position the ejector acts as a stop for the uppermost coin in the chute, maintaining contact with the coin so that it cannot be easily removed from the outlet 30, and thus, is a means for preventing theft of coins from the chute via outlet 30.

With the channel full of the file or stack of edge-to-edge coins, when coins are to be paid out, the hopper dispenses coins into the inlet at the lower end of the channel as illustrated in FIG. 1. As a new coin is forced into the channel from the hopper, the file of coins is advanced upwardly so that the uppermost coin 28 forces biased ejector roller 36 toward edge panel 32, opposite and away from channel outlet 30. The upper end of edge panel 34 has a cammed surface 35 so that as the coin is continually urged upwardly by the file of lower coins, it also is urged out of the channel since it follows the cammed surface 35 because of the bias of ejector roller 36 which continues to force it toward outlet slot 30 as shown in FIG. 3. Once upper coin 28 has been forced upwardly sufficiently to clear outlet slot 30, it is ejected through the slot by the force of spring 20 biased on ejector roller 36. As the roller returns to the first position, the uppermost coin is strongly ejected through outlet slot 30 thereby maintaining the slot opening clear of coins which would otherwise accumulate during a multiple coin payout. Preferably, bias spring 20 is strong enough so that the coin will be propelled up to 6 to 8″ from the slot within the coin payout tray.

It is also important that the ejector be located so that roller 36 is offset relative to the center of channel 25 between edge panels 32 and 34. Thus, in the first position shown in FIG. 2, ejector roller 36 is off-center in channel 25 in a direction away from outlet slot 30. As also shown in FIG. 1, front panel 14 may be provided with an aperture 22 through which axle 38 extends and is secured to bracket 24. Moreover, axle 38 may be in the form of a pin or shank of a bolt extending through bracket 24 and the channel, with the opposite end secured by a nut or the like for retaining the roller.

The length of the escalator between the inlet and the outlet is preferably such that it will accept any plurality of coins, with the specific length depending upon the vertical distance between the hopper and the coin payout tray. However, because of the location and operation of the ejector, no matter how many coins the escalator can accept and to what extent the coins are worn or have differences in token or coin diameters of a given denomination, accuracy in ejection and concomitant coin count is assured. For example, nonuniformity of tokens from different sources, or variations in coin wear, particularly larger denominations such as "Ike" dollars, results in diameter differences of up to 0.040" between coins or tokens of a given denomination. Where the stack comprises larger numbers of coins, such diameter discrepancies could result in substantial variations of the overall stack height from time to time. However, the ejector of the present device will successfully eject the uppermost coin of the stack, regardless of such coin or token diameter differences, since its operation is not dependent on or sensitive to absolute stack height uniformity. Instead, so long as the uppermost coin will be pushed against and displace the ejector against the spring bias, and is elevated sufficiently to clear the outlet slot, it will be suitably ejected.

Because of the features of the improved coin or token handling apparatus of the invention described herein, problems of cheating or theft of coins from the escalator channel is effectively eliminated, as is jamming of the payout slot opening caused by accumulation of coins and problems in handling and ejecting coins where there are coin stack height variations due to differences in coin diameters. These as well as other advantages will be evident to those skilled in the art as will be equivalent modifications of the apparatus within the purview of the invention.

I claim:

1. In a coin handling apparatus including a hopper payout assembly and an elongated duct having front and back panels, first and second edge panels, and a channel therein for receiving a stack of coins of a given denomination in single edge-to-edge file, between an inlet and an outlet end, said inlet end of said channel communicating with a payout chute of said hopper, and a single outlet slot in the first edge panel at said outlet end, the improvement comprising:

a coin ejector assembly including an ejector member for forcibly ejecting coins through said outlet slot comprising a roller extending into said channel adjacent the outlet end thereof, and rotatable about an axis substantially normal to said front and back panels and movable between a first position closer to said second edge panel than said first edge panel and off-center relative to the width of said channel in a direction away from said outlet slot and a second position further away from said outlet slot than said first position, and biasing means for urging said ejector member in said first position whereby said ejector member urges said coins toward said outlet slot and forcibly ejects them therethrough.

2. Apparatus of claim 1 whereby said front panel or said back panel is provided with means for access to said channel.

3. Apparatus of claim 2 wherein said means for access comprises an opening in said panel of a size sufficient to remove coins from said channel.

4. Apparatus of claim 1 including a hinged bracket secured to said roller and said biasing means.

5. Apparatus of claim 4 wherein said biasing means comprises a spring.

6. Apparatus of claim 1 wherein the depth of said channel between said front and back panels is less than twice the tickness of the coins of said denomination to be handled by said machine.

7. Apparatus of claim 3 including a removable member extending into said channel through said opening for preventing removal of coins therethrough.

8. Apparatus of claim 7 wherein said removable member comprises a leaf spring extending through said opening in either said front or said back panel for urging the coins against the opposite front or back panel.

9. In a coin handling apparatus including a hopper payout assembly and an elongated duct having front and back panels, first and second edge panels, and a channel therein for receiving a stack of coins of a given denomination in single edge-to-edge file, between an inlet and an outlet end, said inlet end of said channel communicating with a payout chute of said hopper, and a single outlet slot in the first edge panel at said outlet end, the improvement comprising:

a coin ejector assembly including a pin ejector member extending into said channel adjacent the outlet end thereof along an axis substantially normal to the face of said coins in said stack for forcibly ejecting coins through said outlet slot and movable between a first position closer to said second edge panel then said first edge panel and off-center relative to the width of said channel in a direction away from said outlet and a second position further away from said outlet slot than said first position, and biasing means for urging said ejector member in said first position whereby said ejector member urges said coins toward said outlet slot and forcibly ejects them therethrough.

10. Apparatus of claim 8 wherein ejector assembly includes a roller secured on said pin ejector member.

* * * * *